US010208717B2

(12) United States Patent
Iwamoto et al.

(10) Patent No.: US 10,208,717 B2
(45) Date of Patent: Feb. 19, 2019

(54) INTAKE APPARATUS AND DUMP TRUCK

(71) Applicant: Komatsu Ltd., Tokyo (JP)

(72) Inventors: Sohei Iwamoto, Oyama (JP); Tetsuo Orita, Oyama (JP); Shohei Mantani, Oyama (JP); Shota Mido, Oyama (JP)

(73) Assignee: Komatsu Ltd., Tokyo (JP)

( * ) Notice: Subject to any disclaimer, the term of this patent is extended or adjusted under 35 U.S.C. 154(b) by 134 days.

(21) Appl. No.: 15/306,804

(22) PCT Filed: Jul. 11, 2016

(86) PCT No.: PCT/JP2016/070433
§ 371 (c)(1),
(2) Date: Oct. 26, 2016

(87) PCT Pub. No.: WO2018/011856
PCT Pub. Date: Jan. 18, 2018

(65) Prior Publication Data

US 2018/0202397 A1 Jul. 19, 2018

(51) Int. Cl.
*F02M 35/024* (2006.01)
*F02M 35/10* (2006.01)
*F02M 35/16* (2006.01)

(52) U.S. Cl.
CPC ..... *F02M 35/024* (2013.01); *F02M 35/10* (2013.01); *F02M 35/10098* (2013.01);
(Continued)

(58) Field of Classification Search
CPC ..... B01D 45/06; B01D 46/46; B01D 53/22; B01D 50/00; B01D 46/02; B01D 46/42;
(Continued)

(56) References Cited

U.S. PATENT DOCUMENTS 5,029,465 A 7/1991 Tanimura et al.
9,394,819 B2 7/2016 Nishizawa
(Continued)

FOREIGN PATENT DOCUMENTS

JP 56-061611 A 5/1981
JP 02-284026 A 11/1990
(Continued)

OTHER PUBLICATIONS

International Search Report dated Sep. 13, 2016, issued for PCT/JP2016/070433.

*Primary Examiner* — Duane Smith
*Assistant Examiner* — Minh Chau T Pham
(74) *Attorney, Agent, or Firm* — Locke Lord LLP

(57) ABSTRACT

An intake apparatus includes: an air cleaner unit purifying air sucked from a suction port and discharge the air from a discharge port; a junction pipe section having a plurality of inlet ports while having a single outlet port, each of the inlet ports being connected to the discharge port of the air cleaner unit; a tapered pipe section connected to the outlet port of the junction pipe section and having an inner diameter gradually decreased toward a downstream; a straight pipe section connected to a downstream side of the tapered pipe section and having a constant inner diameter; and an air meter provided in the straight pipe section.

16 Claims, 7 Drawing Sheets

(52) U.S. Cl.
CPC *F02M 35/10118* (2013.01); *F02M 35/10137* (2013.01); *F02M 35/10144* (2013.01); *F02M 35/10386* (2013.01); *F02M 35/164* (2013.01)

(58) Field of Classification Search
CPC ..... B01D 46/00; F02M 35/024; F02M 35/04; B60K 13/02
USPC ..... 55/385.3, 503, 483, 436, 476; 95/17, 14; 96/221, 422; 123/198 E; 180/68.3
See application file for complete search history.

(56) References Cited

U.S. PATENT DOCUMENTS

| | | | | |
|---|---|---|---|---|
| 2004/0255660 | A1 | 12/2004 | Abdolhosseini et al. | |
| 2010/0050865 | A1* | 3/2010 | Johnson | B01D 46/002 95/17 |
| 2011/0067574 | A1* | 3/2011 | Walz | B01D 46/08 96/422 |
| 2011/0232983 | A1* | 9/2011 | Abe | B01D 46/0005 180/68.3 |
| 2016/0177889 | A1* | 6/2016 | Matsubara | F02M 35/10124 55/385.3 |

FOREIGN PATENT DOCUMENTS

| | | | |
|---|---|---|---|
| JP | 2003-003842 | A | 1/2003 |
| JP | 2006-037934 | A | 2/2006 |
| JP | 2011-080421 | A | 4/2011 |
| WO | 2014/203406 | A1 | 12/2014 |

* cited by examiner

INTAKE APPARATUS AND DUMP TRUCK

FIELD

The present invention relates to an intake apparatus and a dump truck.

BACKGROUND

Diesel engines mounted to vehicles such as dump trucks are generally provided with an exhaust gas processing apparatus such as an exhaust gas recirculation (EGR) apparatus, a diesel particulate filter (DPF) apparatus, or a catalyst reducing apparatus in order to purify exhaust gas. The EGR apparatuses mitigate NOx (nitrogen oxides) contained in exhaust gas by taking a part of the exhaust gas in an intake system again and causing combustion. The DPF apparatuses are filters for removing particulate matters (PMs) contained in exhaust gas. In the DPF apparatus, when the amount of sediment PMs exceeds a set value, the PMs are combusted for recycling. Catalyst reducing apparatuses convert NOx into nitrogen molecules and water by a catalyst.

In such an exhaust gas processing apparatus, the air volume sucked into a diesel engine is detected and each operation is controlled based on the detected intake air volume. For example, in the EGR apparatus, the flow rate of exhaust gas taken in an intake system is determined based on the intake air volume. In the DPF apparatus, a differential pressure between an upstream side and a downstream side is calculated from the intake air volume and the amount of sediment PMs is estimated from the calculated differential pressure. In the catalyst reducing apparatus, the amount of reducing agent supplied to a catalyst is optimized based on the intake air volume (e.g. see Patent Literature 1).

CITATION LIST

Patent Literature

Patent Literature 1: International Publication No. WO 2014/203406 A

SUMMARY

Technical Problem

As described above, in order to efficiently purify exhaust gas, how accurately the air volume sucked into a diesel engine can be detected is an extremely important problem. In Patent Literature 1, an air meter is disposed in an intake pipe of a diesel engine and the intake air volume is thereby detected.

Meanwhile, some diesel engines having a large displacement volume include a plurality of air cleaner units. The air discharged from the plurality of air cleaner units is joined at a junction pipe section before reaching a suction port of the diesel engine and then subjected to combustion. In such diesel engines, the intake air volume can be calculated by detecting the air volume discharged from each of the air cleaner units and summing up detected values. The air discharged from the plurality of air cleaner units may, however, be influenced by mutual interference, pressure loss or the like upon joined together. Thus, the total value of the air volumes detected before joining may not always be equivalent to the intake volume sucked into the diesel engine. Meanwhile, the junction pipe section is subject to direct influence of mutual interference, pressure loss or the like as described above, and thus it is difficult to accurately detect the intake air volume.

In consideration to the above circumstances, an object of the present invention is to provide an intake apparatus capable of accurately detecting the intake air volume even with an engine having a large displacement volume and a dump truck including the intake apparatus.

Solution to Problem

In order to achieve the above object, an intake apparatus includes: an air cleaner unit purifying air sucked from a suction port and discharging the air from a discharge port; a junction pipe section having a plurality of inlet ports while having a single outlet port, each of the inlet ports being connected to the discharge port of the air cleaner unit; a tapered pipe section connected to the outlet port of the junction pipe section and having an inner diameter gradually decreased toward a downstream; and a straight pipe section connected to a downstream side of the tapered pipe section and having a constant inner diameter. Further, an air meter is provided in the straight pipe section.

Further, according to the present invention, in the above intake apparatus, at least a part of the tapered pipe section and the straight pipe section is integrally formed by spinning processing, and the air meter is provided at a part formed by spinning processing in the straight pipe section.

Further, according to the present invention, in the above intake apparatus, the discharge port of the air cleaner unit and the inlet port of the junction pipe section are connected via an elastic duct.

Further, according to the present invention, in the above intake apparatus, a rectifier grating is provided between the junction pipe section and the tapered pipe section.

Further, a dump truck according to the present invention includes the above intake apparatus, where a downstream end of the straight pipe section is connected to an intake system of an engine.

Further, according to the present invention, in the dump truck, an elastic duct is provided between the downstream end of the straight pipe section and the intake system of the engine.

Advantageous Effects of Invention

According to the present invention, the air discharged from a plurality of air cleaner units and joined in a junction pipe section passes a tapered pipe section, thereby gains higher flow velocity, and then passes a straight pipe section in a state without dispersion. Thus it becomes possible to accurately detect the intake air volume by an air meter provided in the straight pipe section.

DESCRIPTION OF EMBODIMENTS

Hereinafter, preferred embodiments of an intake apparatus and a dump truck according to the present invention will be described in detail with reference to the accompanying drawings.

Figure 1:
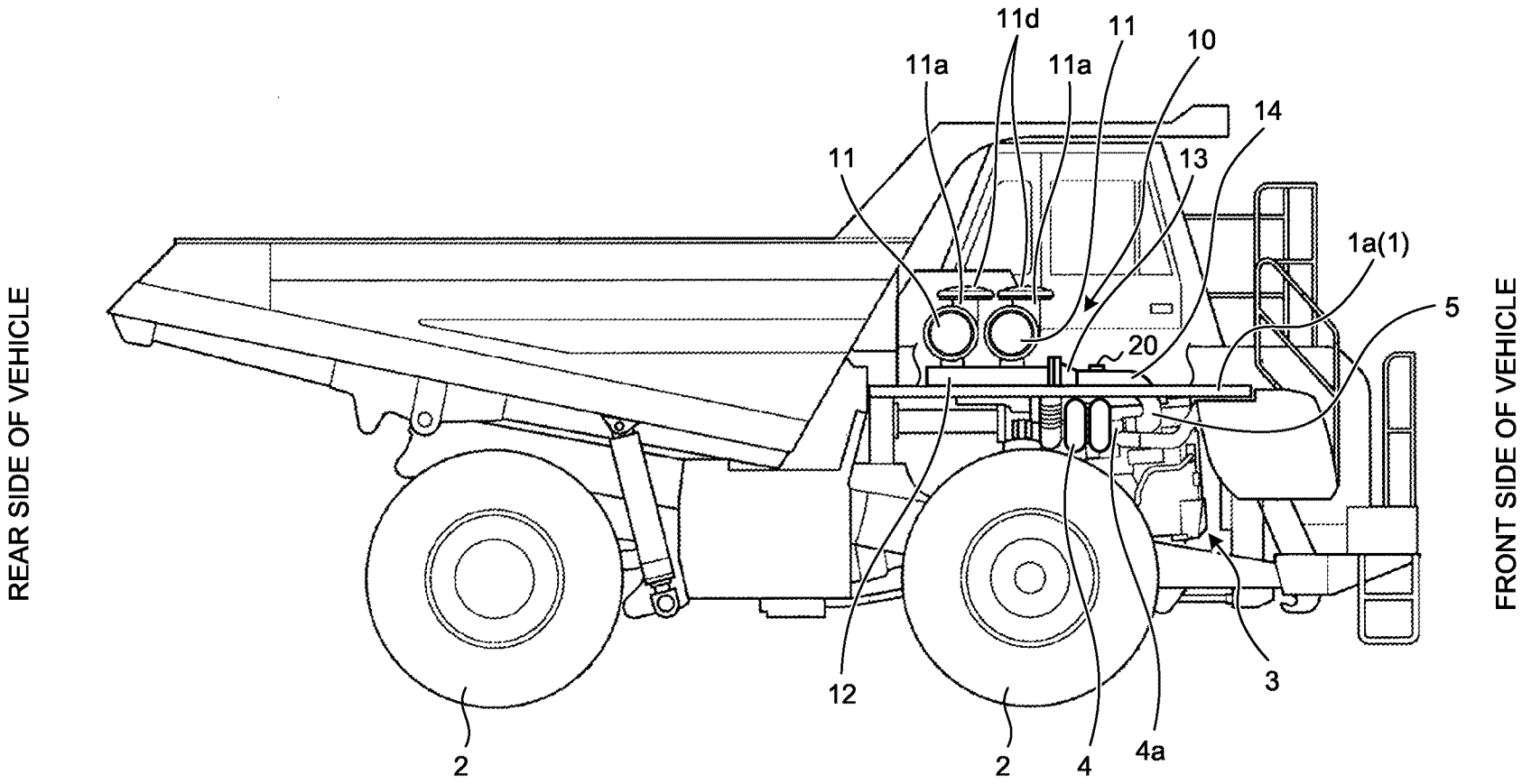
FIG. 1 is a side view of a dump truck mounted with an intake apparatus of an embodiment of the present invention.
Figure 2:
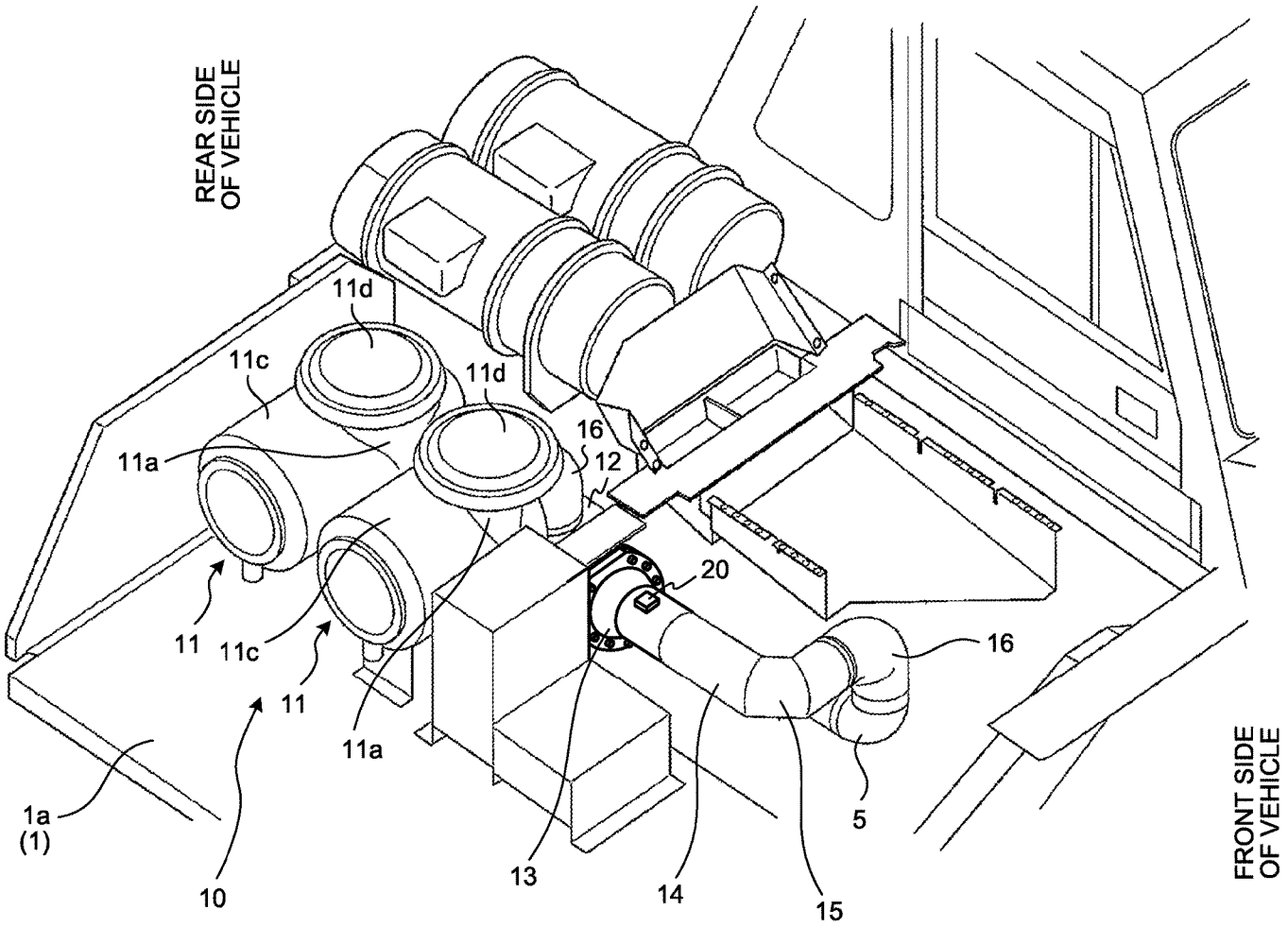
FIG. 2 is a perspective view illustrating an enlarged part of the intake apparatus mounted to the dump truck illustrated in FIG. 1.
Figure 3:
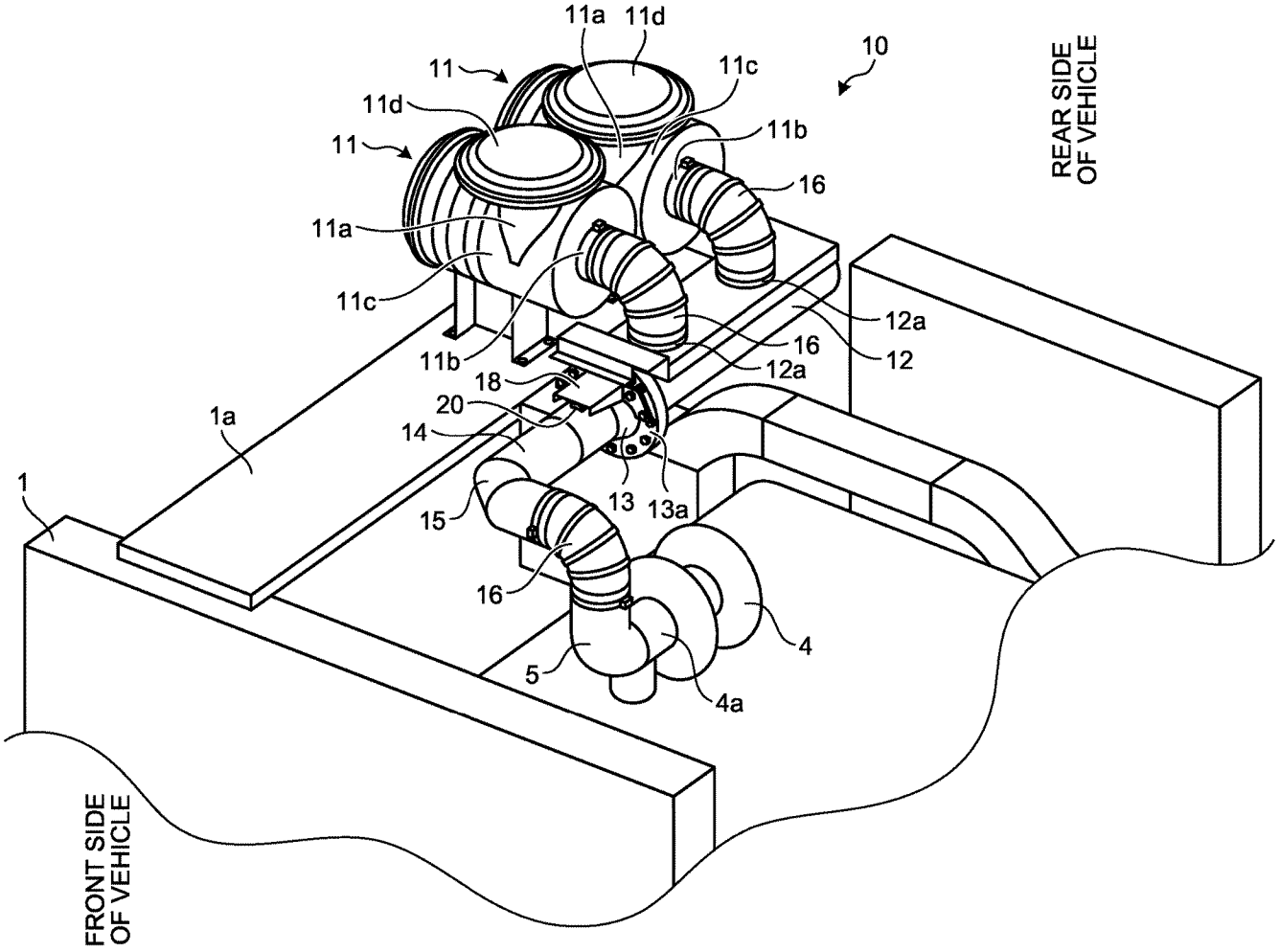
FIG. 3 is a perspective view illustrating an enlarged part of the intake apparatus mounted to the dump truck illustrated in FIG. 1.

FIGS. 1 to 3 illustrate a dump truck mounted with an intake apparatus of an embodiment of the present invention. The dump truck illustrated here as an example includes a tire 2 at each of four corners of a vehicle main body 1 and further includes a diesel engine 3 at a front end of the vehicle main body 1 and travels by driving the tire 2 by the diesel engine 3. The diesel engine 3 is attached with a turbo supercharger 4 and has a relatively large displacement volume. As apparent from FIG. 3, an intake port 4*a* of the turbo supercharger 4, which forms an intake system of the diesel engine 3, is connected to an intake apparatus 10 via an intake pipe 5. The intake apparatus 10 supplies the air after purification to the diesel engine 3 and has two air cleaner units 11, a junction pipe section 12, a tapered pipe section 13, a straight pipe section 14, and a bent pipe section 15. Hereinafter descriptions are given on components of the intake apparatus 10 by assuming that the air cleaner unit 11 is on an upstream side while the turbo supercharger 4 is on a downstream side.

Each of the air cleaner units 11 accommodates a filter element (not illustrated) inside an air cleaner box 11*c* having a suction port 11*a* and a discharge port 11*b*. In the air cleaner unit 11, the air sucked from the suction port 11*a* is purified by the filter element (not illustrated) and then discharged from the discharge port 11*b*. The present embodiment employs the air cleaner unit 11 having the discharge port 11*b* on one end surface of the air cleaner box 11*c* of a cylindrical shape while having the suction port 11*a* on a peripheral surface thereof. As is apparent from FIGS. 2 and 3, two air cleaner units 11 are disposed in parallel at an anterior and a posterior positions on a top surface of a panel 1*a* included in the vehicle main body 1 with the axis of the cylindrical shape of the air cleaner box 11*c* arranged substantially horizontally and the discharge port 11*b* directed toward the center of the vehicle main body 1. Incidentally, a symbol 11*d* in the drawing refers to an intake cover to cover an upper area of the suction port 11*a*.

Figure 4:
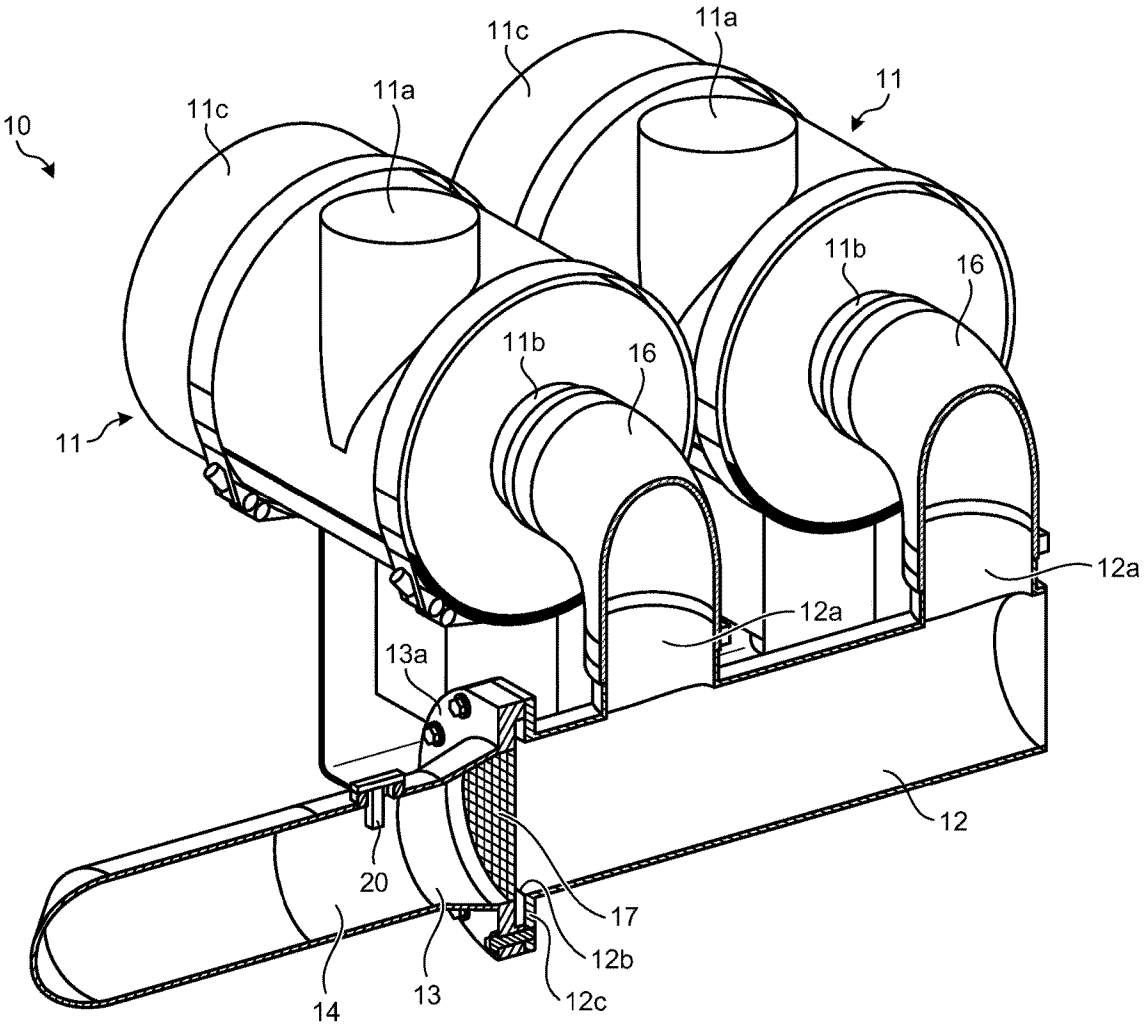
FIG. 4 is a perspective view illustrating a main part of the intake apparatus mounted to the dump truck illustrated in FIG. 1 with a part thereof cut off.
Figure 5:
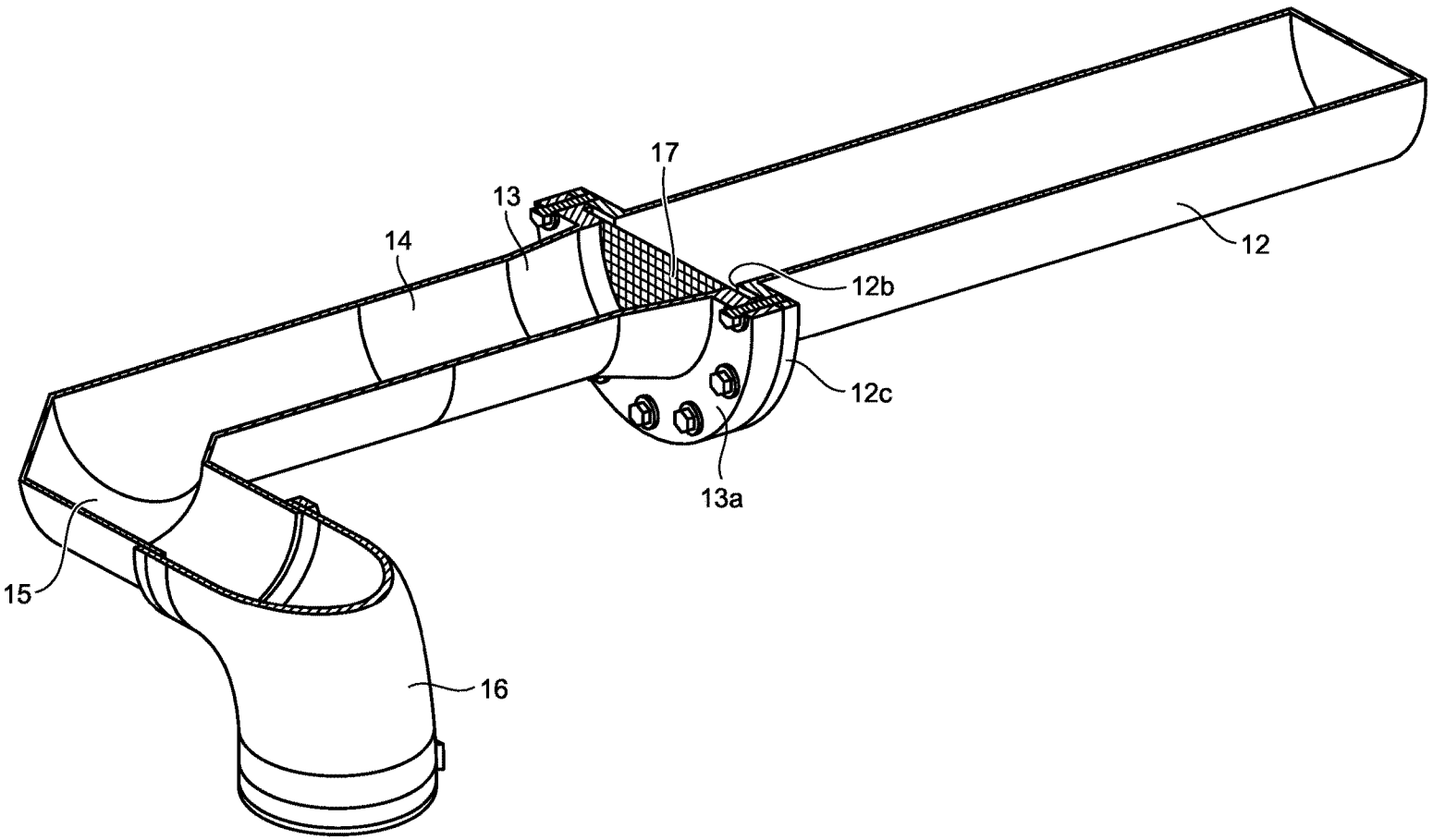
FIG. 5 is a perspective view illustrating the main part of the intake apparatus mounted to the dump truck illustrated in FIG. 1 with a part thereof cut off.
Figure 6:
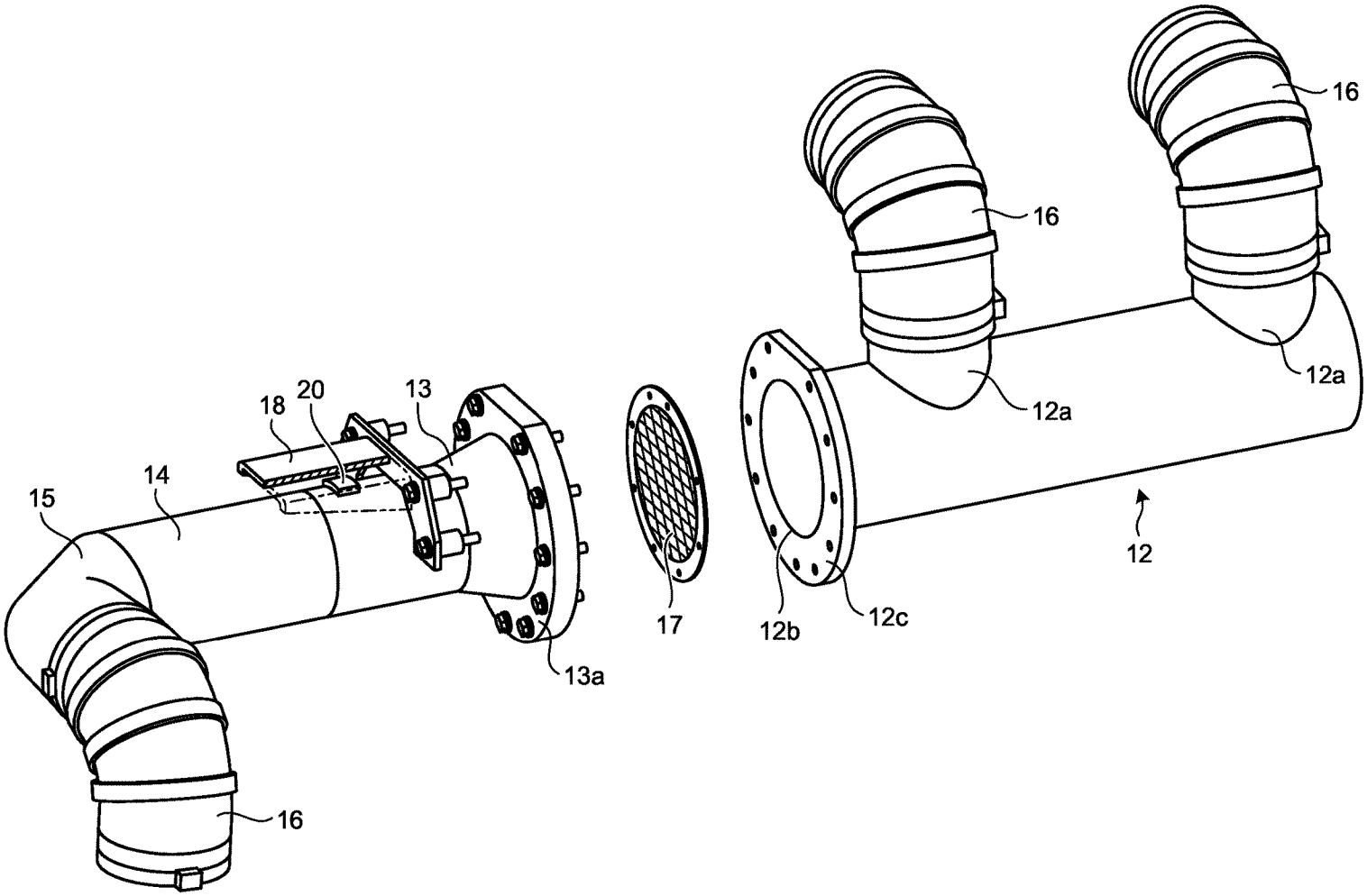
FIG. 6 is an exploded perspective view illustrating the main part of the intake apparatus mounted to the dump truck illustrated in FIG. 1.
Figure 7:
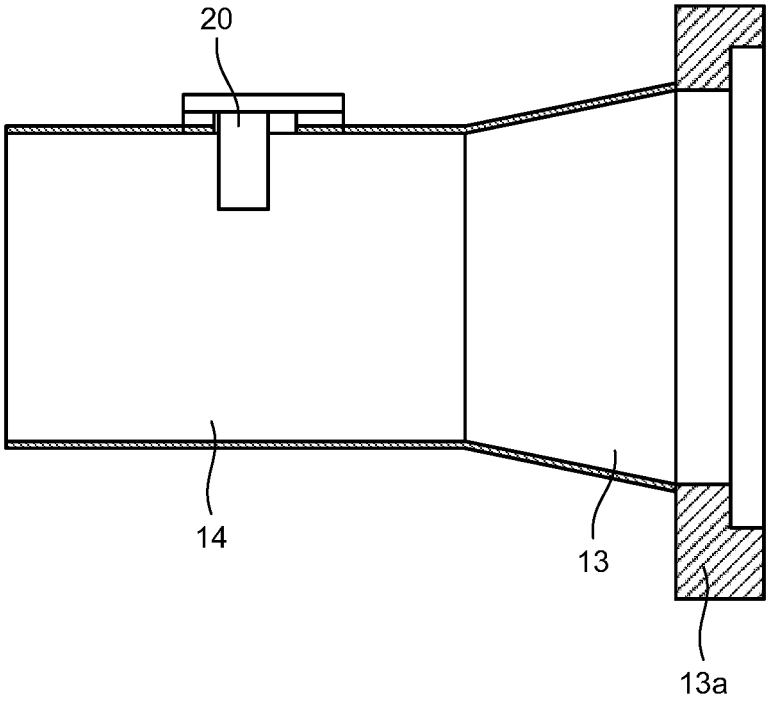
FIG. 7 is a cross-sectional side view illustrating a tapered pipe section and a straight pipe section of the intake apparatus mounted to the dump truck illustrated in FIG. 1.

The junction pipe section 12 is a pipe part, which forms a cylindrical shape and is formed by, for example, welding a thin metal plate. This junction pipe section 12 is disposed substantially horizontally with the axis thereof arranged along a longitudinal direction of the vehicle. As illustrated in FIGS. 4 to 6, a top surface of the junction pipe section 12 is provided with two inlet ports 12*a*. The inlet ports 12*a* are cylindrical parts protruding upward from positions separated from each other. Each of the inlet ports 12*a* is connected to the discharge port 11*b* of the air cleaner unit 11 via an elastic duct 16. The elastic duct 16 is formed by resin and can be elastically deformed when applied with external force. That is, the elastic duct 16 in a state bent substantially by 90 degrees connects the discharge port 11*b* of the air cleaner unit 11 extending horizontally and the inlet port 12*a* of the junction pipe section 12 extending in a vertical direction thereto.

As apparent from the drawings, the junction pipe section 12 has one end positioned on the rear side of the vehicle closed while having the other end positioned on the front side of the vehicle open as an outlet port 12*b*. The open end of the outlet port 12*b* is provided with a flange 12*c* at an outer periphery thereof.

The tapered pipe section 13 is a pipe part having a cross section of a round shape where an inner diameter gradually decreases toward the downstream side. An upstream end of the tapered pipe section 13 is attached with a flange 13*a* and is connected to the outlet port 12*b* of the junction pipe section 12 via a rectifier grating 17 by connecting the flanges 13*a* and 12*c* to each other. The rectifier grating 17 removes bias in the air flow and thereby homogenizes the air flow. The straight pipe section 14 is a pipe part which has a cylindrical shape, extends linearly in continuation with a downstream end of the tapered pipe section 13, and is formed to have a constant inner diameter. The bent pipe section 15 is made of metal and bent by substantially 90 degrees. A downstream end of the bent pipe section 15 is connected to the intake pipe 5 of the turbo supercharger 4 via the elastic duct 16.

The aforementioned tapered pipe section 13, the straight pipe section 14, and the bent pipe section 15 are not supported with respect to the vehicle main body 1 or the diesel engine 3 and is floating in the air between the elastic duct 16 connected to the discharge port 11*b* of the air cleaner unit 11 and the elastic duct 16 connected to the intake port 4*a* of the turbo supercharger 4.

In the intake apparatus 10 of the present embodiment, the aforementioned straight pipe section 14 and the tapered pipe section 13 are integrally formed by spinning processing employing a cold rolled steel plate (SPC material). Furthermore, at a position of the straight pipe section 14 separated by a predetermined distance from the tapered pipe section 13 is attached with a mass air flow (MAF) sensor 20 (air meter) to measure the mass flow rate of the air. A portion covering an upper area of the MAF sensor 20 is provided with a cover member 18 made of steel in an attachable and detachable manner.

The case of integrally forming the straight pipe section 14 and the tapered pipe section 13 by spinning processing is more preferable especially in terms of strength, rigidity, and heat resistance as compared to the case of forming the straight pipe section 14 and the tapered pipe section 13 by resin. Moreover, as compared to resin molding where a mold is required, the spinning processing is suitable for a small-quantity production and thus production cost may be significantly reduced.

Meanwhile, as compared to the case of forming the straight pipe section 14 and the tapered pipe section 13 by aluminum casting, the straight pipe section 14 and the tapered pipe section 13 to which the spinning processing has been applied to are not only preferable in terms of strength and heat resistance but also extremely advantageous in terms of dimensional accuracy. Especially, in terms of roundness and coaxiality of the straight pipe section 14 and the tapered pipe section 13, the spinning processing makes it possible to form with extremely high accuracy as compared to aluminum casting. An inner surface of each of the straight pipe section 14 and the tapered pipe section 13 has no uneven parts and is extremely smooth. Furthermore, in aluminum casting, it is difficult to form a thin plate and thus forming by spinning processing has an advantage of reducing weight.

In the intake apparatus 10 formed in the above manner, the air purified by two air cleaner units 11 is joined together in the junction pipe section 12, then passes the tapered pipe section 13, the straight pipe section 14, and the bent pipe section 15, and supplied to the intake port 4*a* of the turbo supercharger 4. The intake apparatus 10 having two air cleaner units 11 makes it possible to supply the air of an enough volume to even the diesel engine 3 having a large displacement volume. The intake air volume sucked into the diesel engine 3 is detected by the MAF sensor 20 disposed in the straight pipe section 14.

Here, according to this intake apparatus 10, the air discharged from two air cleaner units 11 and joined in the junction pipe section 12 gains higher flow velocity by passing the tapered pipe section 13. Furthermore, the air reaching the tapered pipe section 13 from the junction pipe section 12 passes the rectifier grating 17 and is rectified to include no bias in the flow, so that the air is in a uniform state. Moreover, as described above, in the intake apparatus 10 where the tapered pipe section 13 and the straight pipe section 14 are integrally formed by spinning processing, not only the accuracy of roundness and coaxiality is extremely high but also the inner surfaces are smooth and thus there is no possibility that the passing air generates turbulence. As a result of the above, the MAF sensor 20 disposed in the tapered pipe section 13 by a predetermined distance is not influenced by mutual interference, pressure loss, or the like and thus is capable of detecting the intake air volume with an extremely high accuracy. As described above, the diesel engine 3 of the present embodiment includes the turbo supercharger 4 in the intake system thereof. However, the air compressed by the turbo supercharger 4 has been passed the MAF sensor 20 and thus does not influence the value of the intake air volume measured by the MAF sensor 20.

Therefore even in a case where an exhaust gas processing apparatus such as an EGR apparatus, a DPF apparatus, or a catalyst reducing apparatus is provided to the diesel engine 3, any of the cases can be optimally controlled by using the intake air volume measured by the aforementioned MAF sensor 20 as a reference. Incidentally, an EGR apparatus takes a part of exhaust gas discharged by the diesel engine 3 into the intake system. However, a position where exhaust gas is taken in the intake system is on the downstream side of the MAF sensor 20 and thus the EGR apparatus does not influence the value of the intake air volume measured by the MAF sensor 20.

A use environment of a dump truck mounted with the aforementioned intake apparatus 10 is harsh and thus the tapered pipe section 13, the straight pipe section 14, and the bent pipe section 15 disposed between the elastic ducts 16 are continuously subject to large vibrations. As described above, however, forming by aluminum casting and spinning processing avoid occurrence of problems in terms of strength.

Incidentally, in the aforementioned embodiment the intake apparatus 10 including two air cleaner units 11 has been described as an example; however, three or more air cleaner units 11 may be included. Moreover, the entire straight pipe section 14 is formed integrally with the tapered pipe section 13 by spinning processing; however, it is not required to form the entire straight pipe section 14 integrally with the tapered pipe section 13. It is enough if a part up to a position provided with the MAF sensor 20 is formed integrally with the tapered pipe section 13.

REFERENCE SIGNS LIST

3 DIESEL ENGINE
4 TURBO SUPERCHARGER
4*a* INTAKE PORT
10 INTAKE APPARATUS
11 AIR CLEANER UNIT
11*a* SUCTION PORT
11*b* DISCHARGE PORT
12 JUNCTION PIPE SECTION
12*a* INLET PORT
12*b* OUTLET PORT
13 TAPERED PIPE SECTION
14 STRAIGHT PIPE SECTION
16 ELASTIC DUCT
17 RECTIFIER GRATING
20 MAF SENSOR

The invention claimed is:

1. An intake apparatus, comprising:

an air cleaner unit configured to purify air sucked from a suction port and discharge the air from a discharge port;

a junction pipe section having a plurality of inlet ports while having a single outlet port, each of the inlet ports being connected to the discharge port of the air cleaner unit;

a tapered pipe section connected to the outlet port of the junction pipe section and having an inner diameter gradually decreased toward a downstream; and a straight pipe section connected to a downstream side of the tapered pipe section and having a constant inner diameter, wherein an air meter is provided in the straight pipe section.

2. The intake apparatus according to claim 1, wherein at least a part of the tapered pipe section and the straight pipe section is integrally formed by spinning processing, and the air meter is provided at a part formed by the spinning processing in the straight pipe section.

3. The intake apparatus according to claim 1, wherein the discharge port of the air cleaner unit and the inlet port of the junction pipe section are connected via an elastic duct.

4. The intake apparatus according to claim 1, wherein a rectifier grating is provided between the junction pipe section and the tapered pipe section.

5. A dump truck mounted with the intake apparatus according to claim 1, wherein a downstream end of the straight pipe section is connected to an intake system of an engine.

6. The dump truck according to claim 5, wherein an elastic duct is provided between the downstream end of the straight pipe section and the intake system of the engine.

7. The intake apparatus according to claim 1, wherein an open end of the outlet port is provided with a flange at an outer periphery thereof.

8. The intake apparatus according to claim 7, wherein an upstream end of the tapered pipe section attached with another flange and is connected to the outlet port of the junction pipe section via a rectifier grating by connecting the flange and the another flange to each other.

9. The intake apparatus according to claim 1, wherein two of the air cleaner units are disposed in parallel at an anterior and a posterior positions with axis of an air cleaner box substantially horizontal and the discharge port directed toward a center of a vehicle main body.

10. The intake apparatus according to claim 3, wherein the elastic duct is formed by resin, the elastic duct in a state bent substantially by 90 degrees connects the discharge port extending horizontally and the inlet port extending in a vertical direction thereto.

11. The intake apparatus according to claim 3, further comprising a bent pipe section made of metal and bent by substantially 90 degrees, wherein a downstream end of the bent pipe section is connected to an intake pipe of a turbo supercharger via the elastic duct.

12. The intake apparatus according to claim 11, wherein the tapered pipe section, the straight pipe section, and the bent pipe section are not supported with respect to a vehicle main body and is floating in the air between the elastic duct connected to the discharge port and the elastic duct connected to the intake port of the turbo supercharger.

13. The intake apparatus according to claim 1, wherein the spinning processing employs a cold rolled steel plate (SPC material).

14. The intake apparatus according to claim 1, wherein a portion covering an upper area of the air meter is provided with a cover member made of steel.

15. The intake apparatus according to claim 1, wherein the straight pipe section and the tapered pipe section are formed by aluminum casting.

16. The intake apparatus according to claim 1, wherein at least a part of the tapered pipe section and the straight pipe section are integrally formed by spinning processing so as to increase strength, rigidity and heat resistance, dimensional accuracy, roundness, coaxiality, even parts, smoothness and to reduce weight.

* * * * *